US007560638B2

(12) United States Patent
Susami

(10) Patent No.: US 7,560,638 B2
(45) Date of Patent: Jul. 14, 2009

(54) ELECTRONIC PERCUSSION INSTRUMENT, SYSTEM, AND METHOD WITH VIBRATION

(75) Inventor: Ryo Susami, Kita-ku (JP)

(73) Assignee: Roland Corporation, Hamamatsu (JP)

( * ) Notice: Subject to any disclaimer, the term of this patent is extended or adjusted under 35 U.S.C. 154(b) by 610 days.

(21) Appl. No.: 11/030,032

(22) Filed: Jan. 6, 2005

(65) Prior Publication Data

US 2005/0150349 A1 Jul. 14, 2005

(30) Foreign Application Priority Data

Jan. 8, 2004 (JP) ..... 2004-003270

(51) Int. Cl.
*G10H 3/12* (2006.01)

(52) U.S. Cl. ..... 84/723; 84/745; 84/746; 84/422.3

(58) Field of Classification Search ..... 84/723, 84/730, 746, 745, 402, 422.3
See application file for complete search history.

(56) References Cited

U.S. PATENT DOCUMENTS 4,899,631 A * 2/1990 Baker ..... 84/719
4,977,813 A * 12/1990 Norimatsu ..... 84/722
5,005,460 A * 4/1991 Suzuki et al. ..... 84/600
5,115,705 A * 5/1992 Monte et al. ..... 84/617
5,164,697 A * 11/1992 Kramer ..... 338/69
5,231,283 A * 7/1993 Starkey et al. ..... 250/229
5,245,130 A * 9/1993 Wheaton ..... 84/742
5,523,522 A * 6/1996 Koseki et al. ..... 84/21
5,780,759 A * 7/1998 Szalay ..... 84/454
5,929,361 A * 7/1999 Tanaka ..... 84/742
6,815,603 B2 * 11/2004 Kato et al. ..... 84/744
6,815,604 B2 * 11/2004 Toda ..... 84/746
6,846,980 B2 * 1/2005 Okulov ..... 84/646
6,951,977 B1 * 10/2005 Streitenberger et al. ..... 84/626
7,058,190 B1 * 6/2006 Zakarauskas et al. ..... 381/122
7,102,068 B2 * 9/2006 Kitayama ..... 84/607
7,285,718 B2 * 10/2007 Sasaki ..... 84/744
2002/0148346 A1 * 10/2002 Okulov ..... 84/613
2003/0159571 A1 * 8/2003 Yamaguchi ..... 84/720
2004/0035284 A1 * 2/2004 Tamura et al. ..... 84/634
2004/0144237 A1 * 7/2004 Hoshiai et al. ..... 84/612
2005/0150349 A1 * 7/2005 Susami ..... 84/299
2007/0234882 A1 * 10/2007 Usa et al. ..... 84/612

FOREIGN PATENT DOCUMENTS

JP 9-97075 4/1997
JP 2003-167574 6/2003

* cited by examiner

*Primary Examiner*—David S. Warren
(74) *Attorney, Agent, or Firm*—Foley & Lardner LLP

(57) ABSTRACT

An electronic percussion instrument includes input means and musical tone generation control means. The input means allows for a vibration level of a vibration of an operator and position information that conforms to a position of the operator to be input. The musical tone generation control means in one in which whether or not the generation of a musical tone based on the vibration level and the position information is instructed is controlled in those cases where the vibration level has been input by the input means.

48 Claims, 9 Drawing Sheets

| Displacement Speed / Position | V0 | V1 | V2 | V3 | V4 | V5 |
|---|---|---|---|---|---|---|
| Open | 0 | 1 | 2 | 3 | 4 | 5 |
| Half Open | 1 | 2 | 3 | 4 | 5 | 5 |
| Slightly Open | 2 | 2 | 3 | 4 | 5 | 6 |
| Closed | 0 | 1 | 2 | 3 | 3 | 3 |
| Tightly Closed | -1 | 0 | 0 | 0 | 1 | 1 |

FIG. 6

ELECTRONIC PERCUSSION INSTRUMENT, SYSTEM, AND METHOD WITH VIBRATION

CROSS-REFERENCE TO RELATED PATENT APPLICATIONS

Japan Priority Application 2004-003270, filed Jan. 8, 2004 including the specification, drawings, claims, and abstract, is incorporated herein by reference in its entirety.

BACKGROUND OF THE INVENTION

1. Field of the Invention

Embodiments of the present invention relate to an electronic percussion instrument and, in particular embodiments, to an electronic percussion instrument in which it is possible to set the threshold value for the determination of whether or not to make the vibration level of the upper cymbal in an electronic hi-hat cymbal the trigger signal for musical tone generation in conformance with the position and/or the displacement speed of the upper cymbal.

2. Related Art

For some time, electronic percussion instruments have been provided that mimic acoustic hi-hat cymbals and, with this kind of electronic percussion instrument, the configuration is such that the timbre of the hi-hat is controlled in conformance with the amount of stepping on the foot pedal, in other words, the amount of the displacement of the upper cymbal based on the stepping on the foot pedal. For example, in Japanese Laid-Open Patent Application Publication (Kokai) Number Hei 9-97075 (Patent Reference 1), a sensor (a displacement sensor), which is disposed in the foot pedal for the detection of the amount that the foot pedal has been stepped on, is disclosed.

On the other hand, an electronic hi-hat cymbal in which the upper cymbal is moved up and down in conformance with the amount that a pedal is stepped on and a performance sensation that is the same as that of an acoustic hi-hat cymbal can be mimicked is cited in, for example, Japanese Laid-Open Patent Application Publication (Kokai) Number 2003-167574 (Patent Reference 2).

In the case where a displacement sensor such as that cited in Patent Reference 1 is installed in an electronic hi-hat cymbal in which the upper cymbal is movable such as that cited in Patent Reference 2, a musical tone is generated in the sound generation section that conforms to the position of the upper cymbal that has been detected by the displacement sensor. The musical tone is generated in conformance with the vibration due to the striking of the upper cymbal or the contact between the upper cymbal and the lower cymbal. In general, in those cases where the vibration sensor detects the vibration level of the upper cymbal and the level has exceeded a specified threshold value, a trigger signal that instructs the generation of a musical tone is output to the sound source section.

However, in an electronic percussion instrument such as those described above, there are cases in which the vibration level that is detected by the vibration sensor is, depending on the position and displacement speed of the upper cymbal, something that is due to an erroneous signal or noise. Because of this, there has been the problem that even when a specified threshold value has been set, erroneous sound generation occurs due to that kind of erroneous signal or noise.

For example, in those cases where there is a weak contact sliding position between the upper cymbal and the lower cymbal, when the upper cymbal is struck, the coming into contact of the upper cymbal and the lower cymbal subtly repeats. The noise at that time is detected by the vibration sensor and, when a trigger signal is repeatedly output to the sound source section because of that, erroneous sound generation due to the noise is produced.

In addition, for example, due to the rapid release of a pedal that has been stepped on, the upper cymbal vibrates due to a rapid movement upward from the bottom. The vibration level at that time is detected by the vibration sensor and, when a trigger signal is output to the sound source section, an erroneous sound generation is produced despite the fact that the state is one in which a musical tone should not be generated.

SUMMARY OF THE INVENTION

Embodiments of the present invention address problems as discussed above and relate to an electronic hi-hat cymbal, system, and process with which it is possible to modify and set the threshold value for the determination of whether or not to make the vibration level of the upper cymbal the trigger signal for musical tone generation in conformance with the position and/or the displacement speed of the upper cymbal.

An electronic percussion instrument in accordance with a first embodiment is furnished with input means in which the vibration level of the vibration of an operator and the position information. that conforms to the position of the operator are input, and musical tone generation control means with which whether or not the generation of a musical tone based on the vibration level and the position information is instructed is controlled in those cases where the vibration level has been input by the input means.

By means of an electronic percussion instrument in accordance with the first embodiment, when the vibration level of the vibration of the operator is input by the input means, whether or not the generation of a musical tone is instructed is controlled by the musical tone generation control means based on the vibration level and the position information for said operator.

An electronic percussion instrument in accordance with a second embodiment is furnished with threshold modification means in which the threshold value for the vibration level is modified based on the position information that has been input by the input means, and the musical tone generation control means is one in which the generation of a musical tone is instructed in those cases where the vibration level that has been input by the input means has exceeded the threshold value that has been modified by the threshold modification means.

By means of an electronic percussion instrument in accordance with the second embodiment, in addition to an action that is the same as that of an electronic percussion instrument in accordance with the first embodiment, the threshold value for said vibration level is modified by the threshold modification means based on the position information that has been input by the input means. In addition, in those cases where the vibration level that has been input by said input means has exceeded the threshold value that has been modified, the generation of a musical tone is instructed by the musical tone generation control means.

An electronic percussion instrument in accordance with a third embodiment is furnished with displacement speed detection means in which the displacement speed of the operator is detected based on the position information that has been input in the input means, and threshold modification means with which the threshold value for the vibration level is modified in conformance with the displacement speed that has been detected by the displacement speed detection means, and the musical tone generation control means is one in which the generation of a musical tone is instructed in those cases where the vibration level that has been input by the input means has exceeded the threshold value that has been modified by the threshold modification means.

By means of an electronic percussion instrument in accordance with the third embodiment, in addition to an action that is the same as that of an electronic percussion instrument in accordance with the first embodiment, the displacement speed of said operator is detected by the displacement speed detection means based on the position information that has been input by the input means, and the threshold value for said vibration level is modified by the threshold modification means in conformance with the displacement speed. In addition, in those cases where the vibration level that has been input by said input means has exceeded the threshold value that has been modified, the generation of a musical tone is instructed by the musical tone generation control means.

An electronic percussion instrument in accordance with a fourth embodiment is furnished with vibration level modification means in which the vibration level that has been input by the input means is modified based on the position information that has been input in the input means, and the musical tone generation control means is one in which the generation of a musical tone is instructed in those cases where the vibration level that has been modified by the vibration level modification means has exceeded a specified threshold value.

By means of an electronic percussion instrument in accordance with the fourth embodiment, in addition to an action that is the same as that of an electronic percussion instrument in accordance with the first embodiment, the vibration level that has been input by the input means is modified by the vibration level modification means based on the position information that has been input by the input means. In addition, in those cases where the vibration level that has been modified by the vibration level modification means has exceeded a specified threshold value, the generation of a musical tone is instructed by the musical tone generation control means.

An electronic percussion instrument in accordance with a fifth embodiment is furnished with displacement speed detection means in which the displacement speed of the operator is detected based on the position information that has been input in the input means, and vibration level modification means in which the vibration level that has been input by the input means is modified in conformance with the displacement speed that has been detected by the displacement speed detection means, and the musical tone generation control means is one in which the generation of a musical tone is instructed in those cases where the vibration level that has been modified by the vibration level modification means has exceeded a specified threshold value.

By means of an electronic percussion instrument in accordance with the fifth embodiment, in addition to an action that is the same as that of an electronic percussion instrument in accordance with the first embodiment, the displacement speed of said operator is detected by the displacement speed detection means based on the position information that has been input by the input means, and the vibration level that has been input by said input means is modified by the vibration level modification means in conformance with the displacement speed. In addition, in those cases where the vibration level that has been modified by the vibration level modification means has exceeded a specified threshold value, the generation of a musical tone is instructed by the musical tone generation control means.

An electronic percussion instrument in accordance with a sixth embodiment is furnished with vibration detection means with which the vibration level of an operator is detected, and position information acquisition means in which the position information that conforms to the position of the operator is acquired, and musical tone generation control means in which whether or not the generation of a musical tone based on the vibration level and the position information that has been acquired by the position information acquisition means is instructed is controlled in those cases where the vibration level has been detected by the vibration detection means.

By means of an electronic percussion instrument in accordance with the sixth embodiment, when the vibration level of the operator is detected by the vibration detection means, whether or not the generation of a musical tone is instructed is controlled by the musical tone generation control means based on the vibration level and the position information that has been acquired by the position acquisition means.

An electronic percussion instrument in accordance with a seventh embodiment is furnished with threshold modification means with which the threshold value for the vibration level is modified in conformance with the position information that has been acquired by the position information acquisition means, and the musical tone generation control means is one in which the generation of a musical tone is instructed in those cases where the vibration level that has been detected by the vibration detection means has exceeded the threshold value that has been modified by the threshold modification means.

By means of an electronic percussion instrument in accordance with the seventh embodiment, in addition to an action that is the same as that of an electronic percussion instrument in accordance with the sixth embodiment, the threshold value for said vibration level is modified by the threshold modification means based on the position information that has been acquired by the position information acquisition means. In addition, in those cases where the vibration level that has been detected by the vibration detection means has exceeded the threshold value that has been modified, the generation of a musical tone is instructed by the musical tone generation control means.

An electronic percussion instrument in accordance with an eighth embodiment is furnished with displacement speed detection means in which the displacement speed of the operator is detected based on the position information that has been acquired by the position information detection means, and vibration level modification means in which the threshold value for the vibration level is modified in conformance with the displacement speed that has been detected by the displacement speed detection means, and the musical tone generation control means is one in which the generation of a musical tone is instructed in those cases where the vibration level that has been detected by the vibration detection means has exceeded the threshold value that has been modified by the threshold modification means.

By means of an electronic percussion instrument in accordance with the eighth embodiment, in addition to an action that is the same as that of an electronic percussion instrument in accordance with the sixth embodiment, the displacement speed of said operator based on the position information that has been acquired by the position information acquisition means is detected, and the threshold value for said vibration level is modified by the threshold modification means in conformance with the displacement speed. In addition, in those cases where the vibration level that has been detected by the vibration detection means has exceeded the threshold value that has been modified, the generation of a musical tone is instructed by the musical tone generation control means.

An electronic percussion instrument in accordance with a ninth embodiment is furnished with vibration level modification means in which the vibration level that has been detected by the vibration level detection means is modified based on the position information that has been acquired by the position information acquisition means, and the musical tone generation control means is one in which the generation of a musical tone is instructed in those cases where the vibration level that has been modified by the vibration level modification means has exceeded a specified threshold value.

By means of an electronic percussion instrument in accordance with the ninth embodiment, in addition to an action that is the same as that of an electronic percussion instrument in accordance with the sixth embodiment, the vibration level that has been detected by the vibration detection means is modified by the vibration level modification means based on the position information that has been acquired by the position information acquisition means. In addition, in those cases where the vibration level that has been modified by the vibration level modification means has exceeded a specified threshold value, the generation of a musical tone is instructed by the musical tone generation control means.

An electronic percussion instrument in accordance with a tenth embodiment is furnished with displacement speed detection means in which the displacement speed of the operator is detected based on the position information that has been acquired by the position information acquisition means, and is furnished with vibration level modification means in which the vibration level that has been detected by the vibration detection means is modified in conformance with the displacement speed that has been detected by the displacement speed detection means, and the musical tone generation control means is one in which the generation of a musical tone is instructed in those cases where the vibration level that has been modified by the vibration level modification means has exceeded a specified threshold value.

By means of an electronic percussion instrument in accordance with the tenth embodiment, in addition to an action that is the same as that of an electronic percussion instrument in accordance with the sixth embodiment, the displacement speed of said operator is detected by the displacement speed detection means based on the position information that has been acquired by the position information acquisition means and the vibration level that has been detected by the vibration detection means is modified in accordance with the displacement speed by the vibration level modification means. In addition, in those cases where the vibration level that has been modified by the vibration level modification means has exceeded a specified threshold level, the generation of a musical tone is instructed by the musical tone generation control means.

In accordance with an electronic percussion instrument of the first embodiment, when the vibration level of the vibration of the operator is input by the input means, whether or not the generation of a musical tone is instructed is controlled by the musical tone generation control means based on the vibration level and the position information for said operator. Therefore, even when there is a position or a displacement speed with which the occurrence of an erroneous sound generation is likely in such cases as, for example, when the upper cymbal of the electronic percussion instrument is in a slightly open position or in those cases where the displacement speed of the upper cymbal is rapid and the like, the generation of the musical tone is controlled taking into account the position information of the upper cymbal. Accordingly, there is the advantageous result that it is always possible to generate an appropriate musical tone without the tone being affected by the position or the displacement speed of the upper cymbal, which is the operator.

In accordance with an electronic percussion instrument of the second embodiment, in addition to the advantageous result that is exhibited by an electronic percussion instrument of the first embodiment, in those cases where the threshold value for the vibration level is modified based on the position information for the operator and the vibration level has exceeded the threshold value that has been modified, the generation of a musical tone is instructed. Therefore, since the threshold value that conforms to the position of the upper cymbal, which is the operator, is modified, the erroneous sound generation that can be produced due to the position of the upper cymbal can be prevented, and there is the advantageous result that it is always possible to generate an appropriate musical tone.

In accordance with an electronic percussion instrument of the third embodiment, in addition to the advantageous result that is exhibited by an electronic percussion instrument of the first embodiment, the threshold value of the vibration level is modified in conformance with the displacement speed of the operator that has been acquired based on the position information of said operator. Therefore, since the threshold value is modified taking into account the displacement speed of the upper cymbal, which is the operator, the erroneous sound generation that can be produced due to the displacement speed of the upper cymbal can be prevented, and there is the advantageous result that it is always possible to generate an appropriate musical tone.

In accordance with an electronic percussion instrument of the fourth embodiment, in addition to the advantageous result that is exhibited by an electronic percussion instrument of the first embodiment, in those cases where the vibration level has been modified based on the position information for the operator and the vibration level that has been modified has exceeded a specified threshold value, the generation of a musical tone is instructed. Therefore, when, for example, the vibration level is compressed in conformance with the position of the upper cymbal, which is the operator, the erroneous sound generation that can be produced due to the position of the upper cymbal can be prevented, and there is the advantageous result that it is always possible to generate an appropriate musical tone.

In accordance with an electronic percussion instrument of the fifth embodiment, in addition to the advantageous result that is exhibited by an electronic percussion instrument of the first embodiment, the vibration level is modified in conformance with the displacement speed of the operator that has been acquired based on the position information of said operator. Therefore, since the threshold value is modified taking into account the displacement speed of the upper cymbal, which is the operator, the erroneous sound generation that can be produced due to the displacement speed of the upper cymbal can be prevented, and there is the advantageous result that it is always possible to generate an appropriate musical tone.

In accordance with an electronic percussion instrument of the sixth embodiment, when the vibration level of the vibration of the operator is detected by the vibration detection means, whether or not the generation of a musical tone is instructed is controlled by the musical tone generation control means based on the vibration level and the position information for said operator that has been acquired by the position information acquisition means. Therefore, even when there is a position or a displacement speed with which the occurrence of an erroneous sound generation is likely in such cases as, for example, when the upper cymbal of the electronic percussion instrument is in a slightly open position or in those cases where the displacement speed of the upper cymbal is rapid and the like, the generation of the musical tone is controlled taking into account the position information of the upper cymbal. Accordingly, there is the advantageous result that it is always possible to generate an appropriate musical tone without the tone being affected by the position or the displacement speed of the upper cymbal, which is the operator.

In accordance with an electronic percussion instrument of the seventh embodiment, in addition to the advantageous result that is exhibited by an electronic percussion instrument of the sixth embodiment, the threshold value for the vibration level is modified based on the position information of the operator and in those cases where the vibration level has exceeded the threshold value that has been modified, the generation of a musical tone is instructed. Therefore, since the threshold value that conforms to the position of the upper cymbal, which is the operator, is modified, the erroneous sound generation that can be produced due to the position of the upper cymbal can be prevented, and there is the advantageous result that it is always possible to generate an appropriate musical tone.

In accordance with an electronic percussion instrument of the eighth embodiment, in addition to the advantageous result that is exhibited by an electronic percussion instrument of the sixth embodiment, the threshold value of the vibration level is modified based on the displacement speed of the operator that has been acquired based on the position information of said operator. Therefore, since the threshold value is modified taking into account the displacement speed of the upper cymbal, which is the operator, the erroneous sound generation that can be produced due to the displacement speed of the upper cymbal can be prevented, and there is the advantageous result that it is always possible to generate an appropriate musical tone.

In accordance with an electronic percussion instrument of the ninth embodiment, in addition to the advantageous result that is exhibited by an electronic percussion instrument of the sixth embodiment, the vibration level is modified based on the position information for the operator and in those cases where the vibration level that has been modified has exceeded a specified threshold, the generation of a musical tone is instructed. Therefore, when, for example, the vibration level has been compressed in conformance with the position information for the upper cymbal, which is the operator, the erroneous sound generation that can be produced due to the position of the upper cymbal can be prevented, and there is the advantageous result that it is always possible to generate an appropriate musical tone.

In accordance with an electronic percussion instrument of the tenth embodiment, in addition to the advantageous result that is exhibited by an electronic percussion instrument of the sixth embodiment, the vibration level is modified in conformance with the displacement speed of the operator that has been acquired based on the position information of said operator. Therefore, since the threshold is modified taking into account the displacement speed of the upper cymbal, which is the operator, the erroneous sound generation that can be produced due to the displacement speed of the upper cymbal can be prevented, and there is the advantageous result that it is always possible to generate an appropriate musical tone.

BRIEF DESCRIPTION OF THE DRAWINGS

FIG. 6 is a drawing that shows a table for obtaining an offset value (SLO) of the threshold value A from a displacement sensor value that has been input from a displacement sensor and a displacement speed that has been detected by a displacement speed detection means;

DETAILED DESCRIPTION OF PREFERRED EMBODIMENTS

Figure 1:
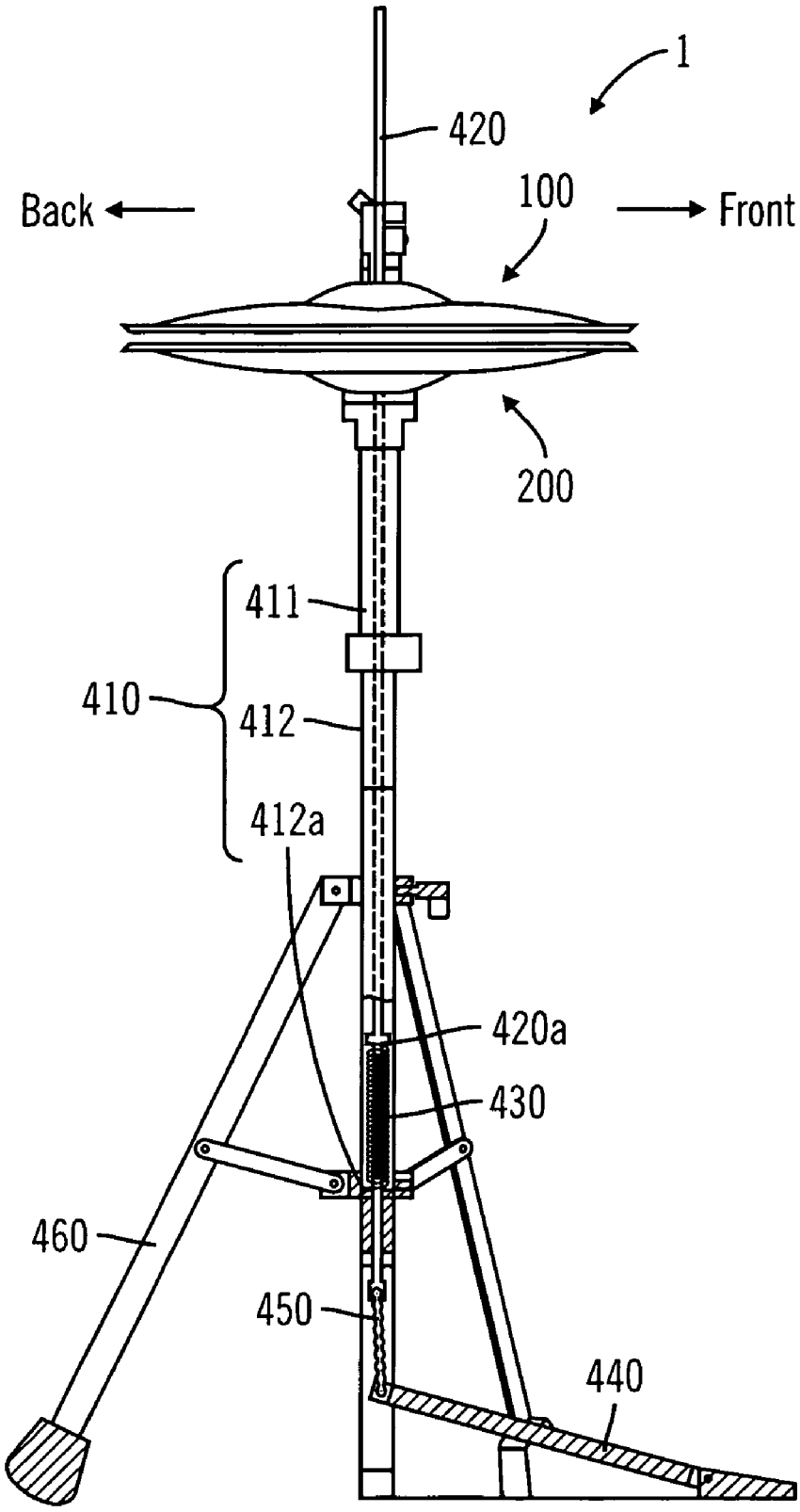
FIG. 1 is a lateral cross-section drawing of an electronic percussion instrument in accordance with an embodiment of the invention.

Explanations will be given below regarding embodiments of the present invention while referring to the attached drawings. FIG. 1 is a lateral cross-section drawing of an electronic hi-hat cymbal, which is an electronic percussion instrument 1 in accordance with an embodiment of the invention. In order to simplify the drawing, in FIG. 1, the detailed structures of the upper cymbal or pad 100, the lower cymbal or pad 200, and the portion that is in between the upper cymbal 100 and the lower cymbal 200 have been shown abbreviated in the drawing.

In this specification, the "front side" of the electronic percussion instrument 1 means the side of the electronic percussion instrument 1 that the performer faces and that is struck by the performer. The "back side" means the opposite side with respect to the center of the upper cymbal 100. In FIG. 1, the "front side" of the electronic percussion instrument 1 is shown toward the right side of the page, and the "back side" is shown toward the left side of the page.

The electronic percussion instrument 1 that is shown in FIG. 1 is furnished with an upper cymbal 100, a lower cymbal 200, an extension rod 420 to which the upper cymbal 100 is linked such that the cymbal can swing, and a hollow shaft section 410 to which the lower cymbal 200 is linked such that the cymbal can swing. The electronic percussion instrument 1 is also furnished with a spring 430 that is fit into the inside lower end of the hollow shaft section 410, a step-on type pedal 440, a joint 450 with which the extension rod 420 and the pedal 440 are linked, leg sections 460 for standing up and supporting the entire electronic percussion instrument 1 that are linked to the hollow shaft section 410, and the like.

The hollow shaft section 410 is configured comprising an upper hollow shaft 411, and a lower hollow shaft 412. The lower hollow shaft 412 has an inside diameter that is greater than the outside diameter of the upper hollow shaft 411. With the hollow shaft section 410, the upper hollow shaft 411 is inserted into the lower hollow shaft 412 and the height of the hollow shaft section 410 is determined by altering the depth of the insertion. By this means, the height of the lower cymbal 200, which is linked to the upper section (the upper hollow shaft 411) of the hollow shaft section 410 by the linkage fitting, is determined. In addition, the joint section 412*a* is disposed on the lower end of the lower hollow shaft 412. The inside diameter of the lower hollow shaft 412 is held in the joint section 412*a* and supports the spring 430 that is fit into the inside from the bottom.

The extension rod 420 is linked on the bottom to the pedal 440 through the joint 450. The configuration is such that the extension rod 420 moves up and down in conformance with the stepping operation of the pedal 440. On the other hand, the upper cymbal 100 is linked to the top of the extension rod 420 by the linkage fitting such that the cymbal can swing. When the extension rod 420 moves up and down in conformance with the stepping operation of the pedal 440, the upper cymbal 100 moves up and down in concert with this.

With regard to the extension rod 420, the lower portion passes through the upper hollow shaft 411 and the lower hollow shaft 412 and together with this, also passes through the spring 430 that has been fit into the inside of the lower hollow shaft 412. The spring 430 is held between the bottom of the joint section 420*a* that is disposed on the extension rod 420 and the top of the joint section 412*a* of the lower hollow shaft 412. Since the extension rod always receives a force applied that impels the rod upward because of this, when a stepping operation of the pedal 440 is not carried out, the upper cymbal 100 and the lower cymbal 200 are separated by a specified interval.

Figure 2A:
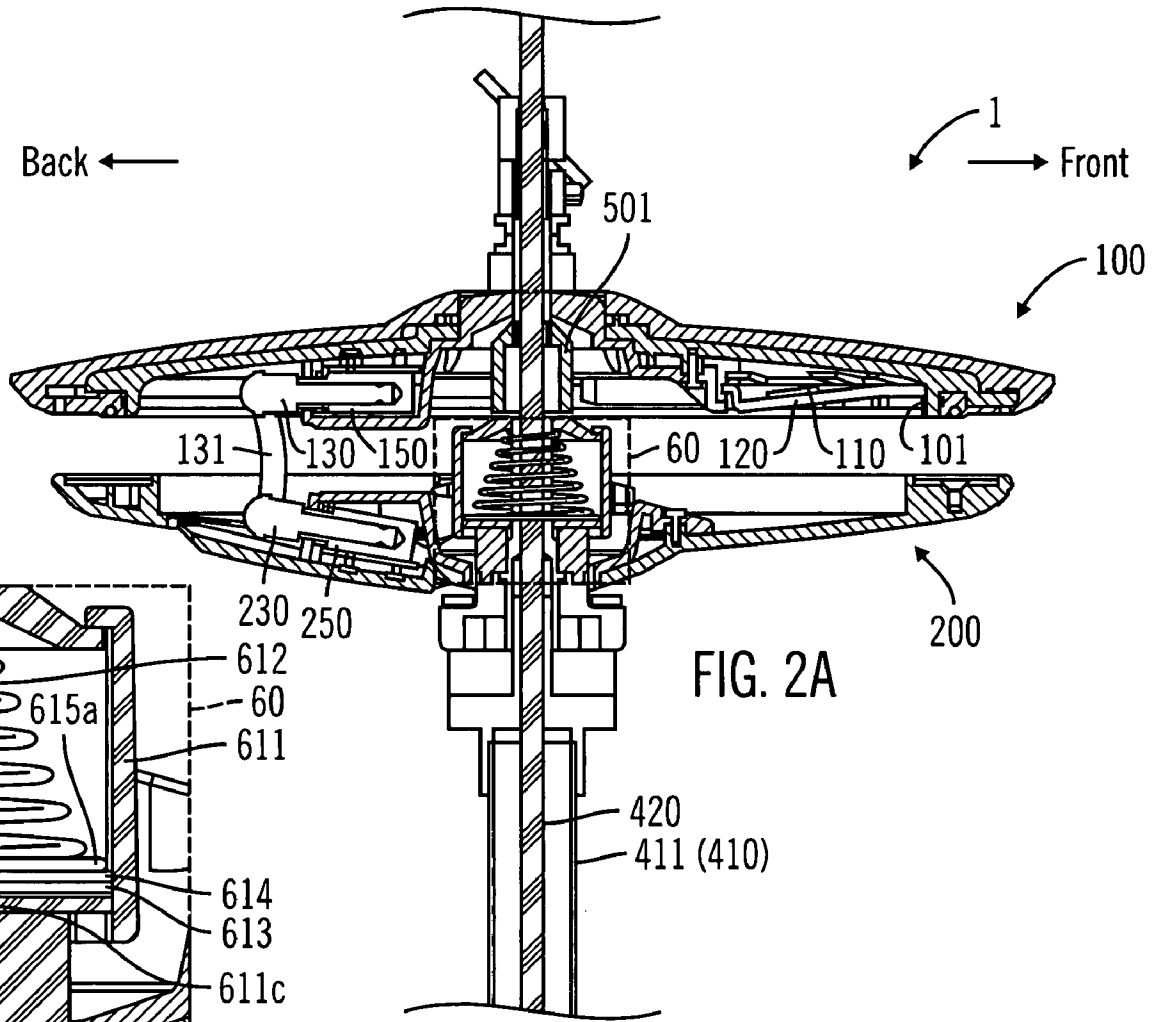
FIG. 2 is a drawing for an explanation of a displacement sensor, wherein FIG. 2(*a*) is an expanded cross-section drawing of the upper cymbal and the lower cymbal portions of the electronic percussion instrument that is shown in FIG. 1, and FIG. 2(*b*) is a drawing in which the displacement sensor portion in (a) has been further expanded.
Figure 2B:
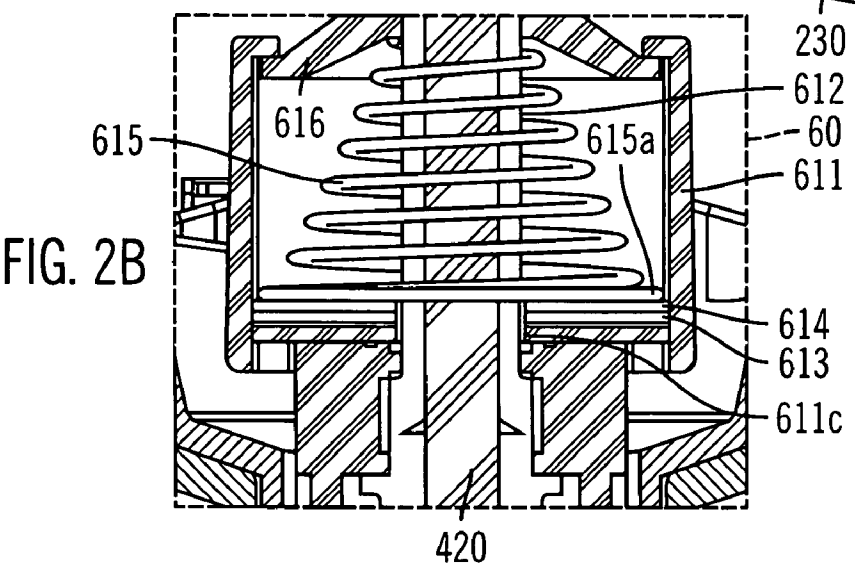

Next, an explanation will be given regarding the displacement sensor 60 for the detection of the displacement of the upper cymbal 100, which varies in conformance with the amount that the pedal 440 is stepped on, in the electronic percussion instrument 1 of an embodiment of the invention while referring to FIG. 2. FIG. 2(*a*) is an expanded cross-section drawing of the upper cymbal 100 and the lower cymbal 200 in the electronic percussion instrument 1 that is shown in FIG. 1, and FIG. 2(*b*) is a drawing in which the displacement sensor 60 portion in FIG. 2(*a*) is expanded further.

The displacement sensor 60 is, as is shown in FIG. 2(*a*), arranged in between the upper cymbal 100 and the lower cymbal 200.

The displacement sensor 60 is, as is shown in FIG. 2(*b*), configured comprising a case 611, a circular sensor sheet 613, a cushion sheet 614, a cone shaped coil spring 615, and a cover section 616. The case 611 in the illustrated embodiments comprises a hollow cylinder that is opened on the upper surface. The circular sensor sheet 613 is housed in the bottom section on the inside of the case 611. The cushion sheet 614 is arranged above the sensor sheet 613 and has roughly the same shape as the sensor sheet 613. The cone shaped coil spring 615 is arranged above the cushion sheet 614 and moves downward from the top and spreads. The cover section 616 has a convex shape pointing toward the top and is in contact with the upper section of the coil spring 615.

In addition, an opening section 611*c* is disposed in the center of the lower surface of the case 611, and the opening section 611*c* is a portion of a pass-through hole that passes through the displacement sensor 60 from top to bottom. Opening sections that become portions of the pass-through hole are also disposed in the respective centers of the members, the sensor sheet 613, the cushion sheet 614, and the cover section 616. A sleeve 612 for the insertion through of the extension rod 420 is inserted through each of the opening sections including the opening section 611*c* as well as the center of the coil spring 615.

The explanation will again refer to FIG. 2(*a*). In the electronic percussion instrument 1 of an embodiment of the invention, when the pedal 440 is stepped on, the space between the upper cymbal 100 and the lower cymbal 200 moves in a gradually closing direction in conformance with the amount of the stepping. At that time, the rotation stopping member 501 that is fixed to the extension rod 420 also is lowered together with the extension rod, which is lowered by stepping on the pedal. When the rotation stopping member 501 is lowered, the cover section 616 that is in contact with the bottom of the rotation stopping member 501 is pressed downward. As a result, the coil spring 615 is pressed against the cushion sheet 614 and compressed, changing shape in the vertical direction due to the compression force.

The change in shape in the coil spring 615 that is produced in this manner with the compression in the vertical direction is detected electrically using the sensor sheet section 613; and the amount that the pedal is stepped on, in other words, the amount of displacement of the upper cymbal 100 is detected.

The sensor sheet section 613 is configured comprising a printed resistance sheet material (not shown in the drawing) and a printed carbon base plate (not shown in the drawing). In order to simplify the drawing, the sensor sheet section 613 is shown as a single member. The printed resistance sheet has a surface that has been uniformly printed with conductive ink. The printed carbon base plate has two independent specified electrode patterns and terminals. The printed carbon base plate is arranged on the bottom surface of the case 611 and has an electrode pattern on the top. The printed resistance sheet member is arranged above the carbon electrode base plate and has the printed surface of conductive ink facing the carbon electrode base plate.

When the coil spring 615 is compressed and changes shape because of the stepping on the pedal 440, the wider section 615*a* of the coil spring 615, which has a conical shape, presses on the printed resistance sheet material of the sensor sheet section 613 with the interposition of the cushion sheet 614; and, because of this, a portion of the printed resistance sheet material is pressed onto the printed carbon base plate. As a result, the conductive ink on the printed resistance sheet material comes into contact with the electrode pattern of the printed carbon base plate, and the electrical resistance value of the printed carbon base plate changes.

The electrical resistance value changes in conformance with the compression and change in shape of the coil spring 615, in other words, the amount of displacement of the upper cymbal 100 due to the stepping on the pedal 440. Specifically, when the amount of compression and change in shape of the coil spring 615 becomes. greater, the area of the flat portion that is formed by the wire material from the wider section 615*a* of the coil spring 615 up to the portion that has been pressed in conformance with the compression force increases. When the area of the flat portion that is formed by the wire material increases, the conductive ink region on the printed resistance sheet material that comes into contact with the electrode pattern of the printed carbon base plate increases. As a result, the electrical resistance value of the printed carbon base plate decreases. The analog electrical resistance value that is equivalent to the amount of displacement of the upper cymbal 100 that has been detected by the displacement sensor is output to a CPU (the CPU 10, which will be discussed later) via wiring (not shown in the drawing) and an output terminal (not shown in the drawing) after being input to an A/D converter (not shown in the drawing) and being digitized.

For the cushion sheet 614, a material having elasticity such as rubber and the like is used. Because of this, when, for example, a pressing force is applied on a single point on the surface of the cushion sheet 614, the pressing force is expanded and transmitted through to the area surrounding the point to which the force is applied.

When the coil spring 615 is pressed onto the sensor sheet section 613 with the interposition of the cushion sheet 614, the portion that is pressed in a helical form by the wire material of the coil spring 615 is made homogeneous. The homogeneous pressing force is transmitted to the sensor sheet section 613. Therefore, since the sensor sheet section 613 can detect the size of the compression and change in shape of the coil spring 615 with sensitivity, the amount of displacement of the upper cymbal 100 can be detected accurately. In addition, since it is set up such that the wider section 615*a* of the conical shaped coil spring 615 is on the bottom, the stability is good and it is possible to detect the size of the compression and change in shape of the coil spring 615 with sensitivity by means of the sensor sheet section 613.

Next, an explanation will be given the regarding vibration sensor 70 in the electronic percussion instrument 1 of an embodiment of the invention, with which the vibration of the upper cymbal 100 is detected, while referring to FIG. 3.

Figure 3:
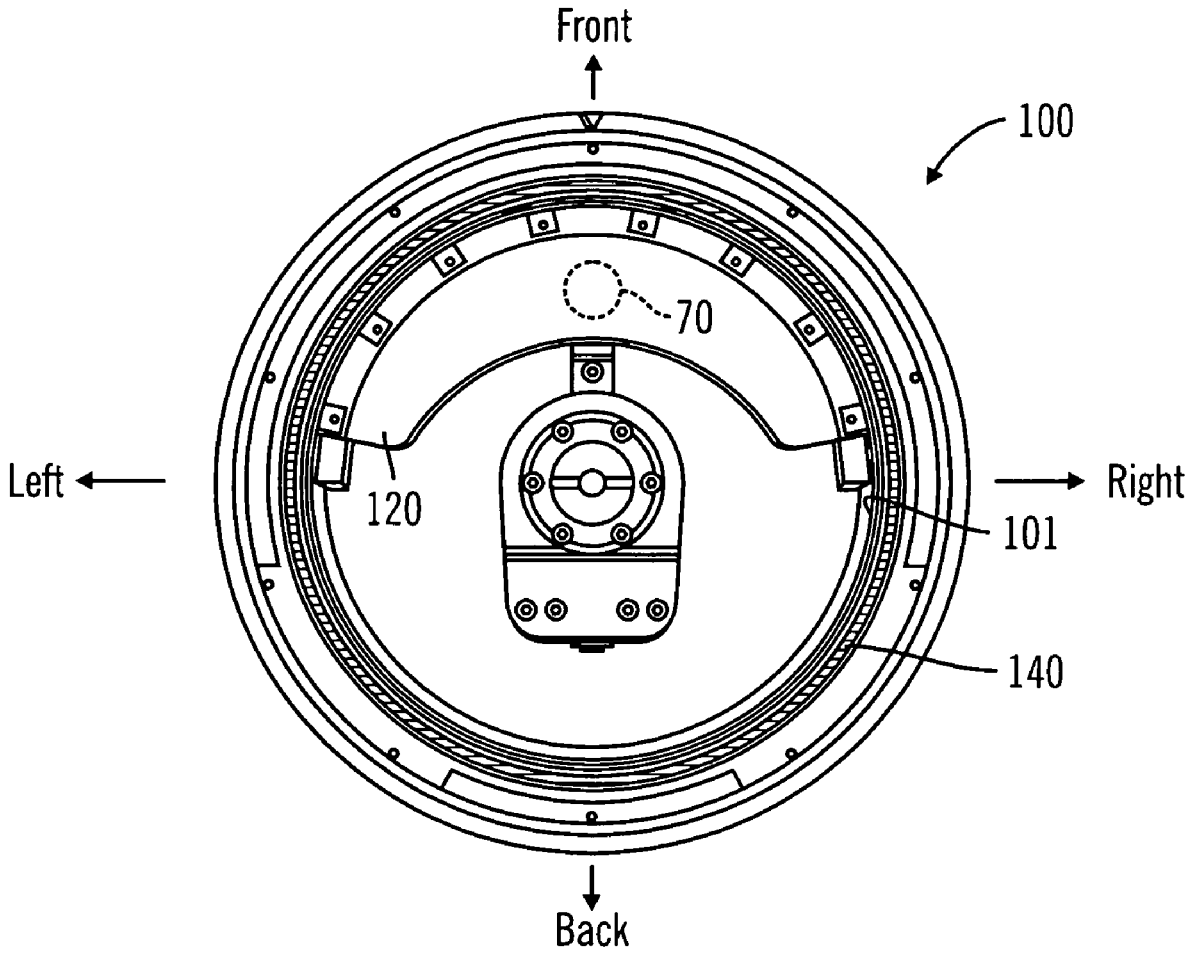
FIG. 3 shows a rear view of an upper cymbal in an electronic percussion instrument in accordance with an embodiment of the invention.

FIG. 3 shows a rear view of the upper cymbal 100 in the electronic percussion instrument 1. In FIG. 3, in order to simplify the drawing, members such as the extension rod 420 and the like are partially omitted from the drawing representation. In this specification, the "rear surface of the upper cymbal 100" means the surface that faces the lower cymbal 200 in the electronic percussion instrument 1. In addition, in FIG. 3, the top of the page is made the "front side" of the upper cymbal 100, the bottom of the page is made the "back side" of the upper cymbal 100, the right side of the page is made the "right side" of the upper cymbal 100, and the left side of the page is made the "left side" of the upper cymbal 100.

As is shown in FIG. 3, the plate shaped vibration sensor attachment frame 120 has an outer periphery that follows along the inner peripheral wall 101 of the frame that configures the upper cymbal 100. The frame 120 is arranged in the front side semicircle of the upper cymbal 100. A space is formed between the vibration sensor attachment frame 120 and the upper cymbal 100 (refer to FIG. 2). The vibration sensor 70 is disposed on the surface of the vibration sensor attachment frame 120 that faces this space (in other words, the surface on the reverse side of the page of the vibration sensor attachment frame 120 that is shown in FIG. 3).

The vibration sensor 70 is a sensor that detects the vibration level of the vibration of the upper cymbal 100 due to the striking of the upper cymbal 100 or the coming into contact of the upper cymbal 100 and the lower cymbal 200 and is, for example, a piezoelectric sensor. When the vibration sensor 70 detects the vibration level, an analog electrical signal that conforms to the vibration level is transmitted by means of wiring that is not shown in the drawing to the stereo jack 150 (refer to FIG. 2) for link output. This analog electrical signal is then further input to the stereo jack 250 for link input on the lower cymbal 200 via a plug 130, a cable 131, and a plug 230 and output to a CPU (the CPU 10 that will be discussed later) from an output terminal that is not shown in the drawing after being input to an A/D converter that is not shown in the drawing and being digitized. Then, in those cases where the vibration level that corresponds to the digital electrical signal is determined to have exceeded a specified threshold value, the signal is processed in the CPU as a vibration for which sound should be generated having been detected. The processing of a sound generation instruction that conforms to the vibration level that has been detected by the vibration sensor 70 will be discussed later.

Figure 4:
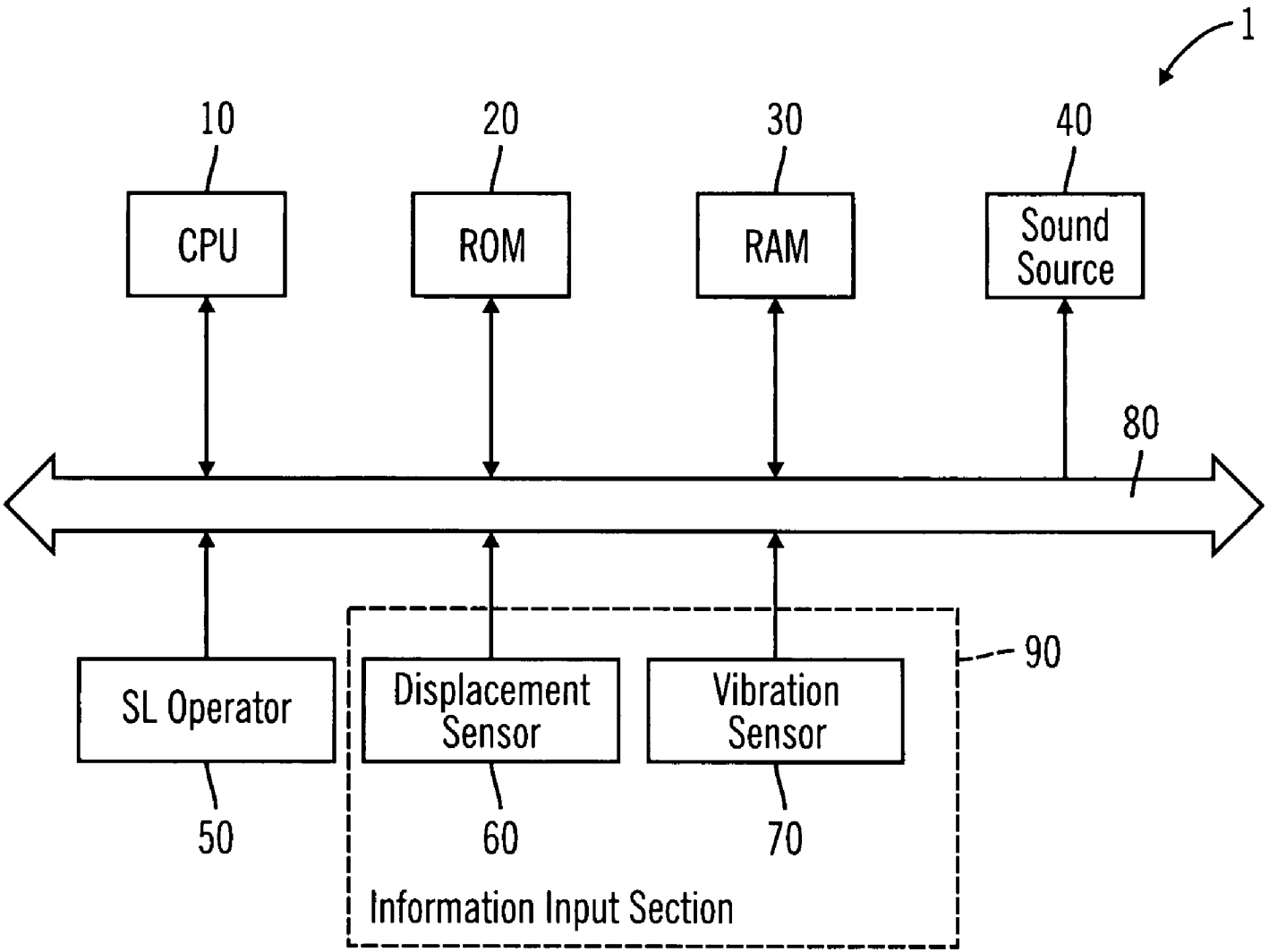
FIG. 4 is a block diagram that shows a configuration of an electronic percussion instrument in accordance with an embodiment of the invention.

FIG. 4 is a block diagram that shows a configuration of the electronic percussion instrument 1 of an embodiment of the present invention. The electronic percussion instrument 1 primarily has the CPU 10, the ROM 20, the RAM 30, the sound source 40, the SL operator 50 for setting the initial value (SL) of the threshold value "A", the data input section 90, and the bus line 80, with which these structures are interconnected. The threshold value "A" is a threshold value for the determination of whether or not to make the vibration level that has been detected by the vibration sensor 70 the trigger signal for the generation of a musical tone.

The CPU 10 is a central processing unit that controls the entire electronic percussion instrument 1 and the ROM 20 stores the various control programs that are executed by the CPU 10 and the fixed data values that are referred to at the time of execution. Programs that may be executed in accordance with processes shown in the flowcharts of FIG. 7 through FIG. 9, which will be discussed later, may be stored in the ROM 20.

The RAM 30 is a rewritable memory that can be accessed randomly and that has working areas in which various register groups that are needed by the control programs that are executed by the CPU 10 are set. The RAM 30 also has temporary areas in which the data that are stored temporarily during processing, are stored and the like. The regions in which the displacement sensor values that have been acquired in the threshold modification processing, which will be discussed later (FIG. 8) as well as their acquisition times, are stored, are provided in the RAM 30. Also, the regions in which the threshold values "A" that have been modified in the same threshold modification processing and the various flags that are used in each of the processes, are stored, are provided in the RAM 30.

The sound source 40 is something with which the digital musical tones are generated based on the displacement sensor values that are output from the displacement sensor 60 in those cases where the vibration level that has been detected by the vibration sensor 70 has been regarded as a trigger signal. The sound source 40 has a waveform ROM (not shown in the drawing). The waveform data for five types of hi-hat sounds (open sound, half open sound, slightly open sound, closed sound, and tightly closed sound) that correspond to the positions of the upper cymbal 100, which are indicated by the displacement sensor values that are detected by the displacement sensor 60, are stored in the waveform ROM.

The SL operator 50 is a volume control operator, which is disposed on an operator panel (not shown in the drawing), that comprises a variable resistance device for setting the initial value (SL) of the threshold value "A". The setting of the initial value (SL) of the threshold value "A" is done by the rotational operation of the SL operator 50.

The data input section 90 is structured comprising the displacement sensor 60 and the vibration sensor 70 discussed above. The data input section 90 outputs, respectively, the displacement sensor value (the position information) that is detected by the displacement sensor 60 and the vibration level that is detected by the vibration sensor 70. The displacement sensor value that is detected by the displacement sensor 60 and the vibration level that is detected by the vibration sensor 70 are both analog values. These analog values are each first input to an A/D converter (not shown in the drawing). In the A/D converter, each analog value is converted into a digital value in accordance with a routine (not shown in the drawing), which is launched every specified time interval, and the digital value is output. In this specification, the "displacement sensor value" and the "vibration level" shown hereinafter both mean values that have been digitized as described above as long as there is no other special explanation.

Figure 5:
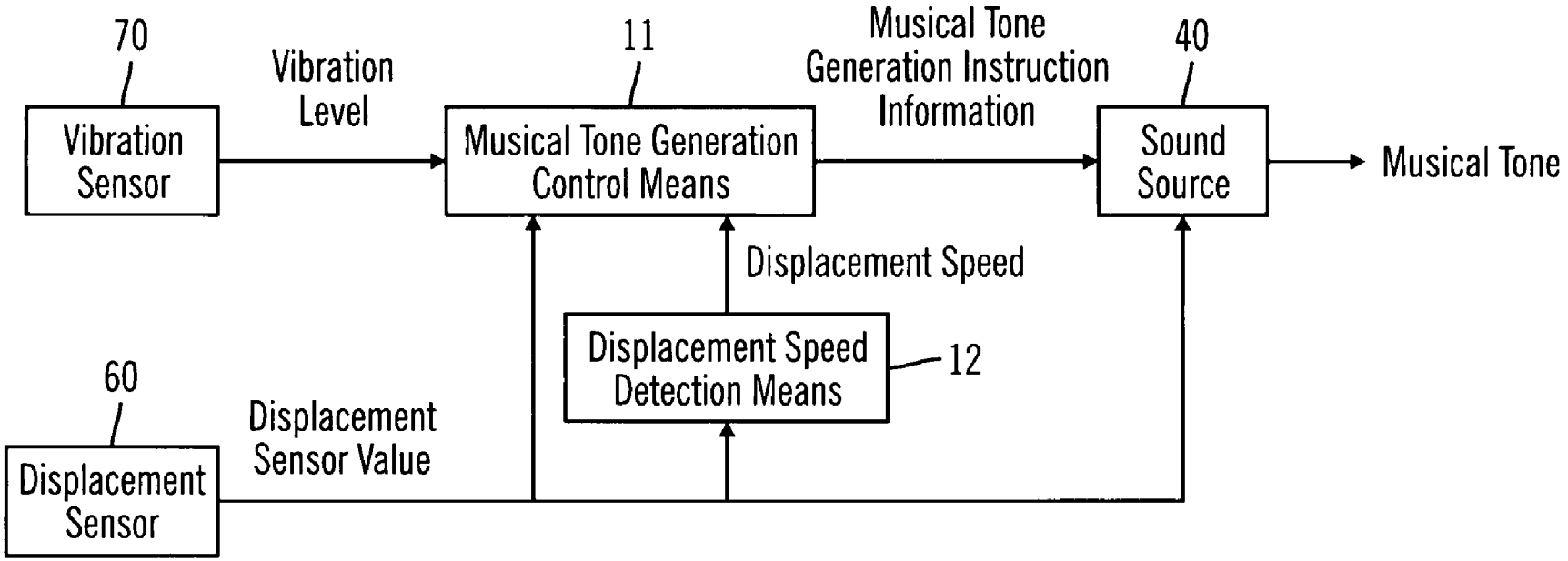
FIG. 5 is a block diagram that shows, conceptually, an overview of an embodiment of the invention.

Next, an explanation of an overview of an embodiment of the invention will be given while referring to FIG. 5. FIG. 5 is a block diagram that shows, conceptually, main portions of an embodiment of the invention that are executed by an electronic percussion instrument 1 that has been configured as described above.

The vibration sensor 70 that is disposed in the electronic percussion instrument 1 outputs the analog vibration level of the vibration due to the striking of the upper cymbal 100 or the contact between the upper cymbal 100 and the lower cymbal 200 to the A/D converter that is not shown in the drawing. When this is done, a digital value of the vibration level is output from the A/D converter to the musical tone generation control means 11.

The displacement sensor 60 that is disposed in the electronic percussion instrument 1 outputs the analog displacement sensor value to the A/D converter. When this is done, a digital displacement sensor value is output from the A/D converter to the musical tone generation control means 11 and, together with this, is output to the displacement speed detection means 12.

The displacement speed detection means 12 derives the displacement speed of the upper cymbal 100 from the displacement sensor value that has been input from the displacement sensor 60 and the displacement sensor value that was input the previous time and outputs the displacement speed to the musical tone generation control means 11.

The musical tone generation control means 11 outputs the musical tone generation instruction information based on the displacement sensor value that has been input from the displacement sensor 60 and the displacement speed that has been input from the displacement speed detection means 12 in those cases where the threshold value "A" has been modified and the vibration level that has been input from the vibration sensor 70 has exceeded that threshold value "A".

The sound source 40 starts the generation of a musical tone having a timbre that conforms to the musical tone generation instruction information that is input from the musical tone generation control means 11 and the displacement sensor value that has been input from the displacement sensor 60.

FIG. 6 is a drawing that shows a table in the musical tone generation control means 11 for obtaining an offset value (SLO) of the threshold value "A" from the displacement sensor value that has been input from the displacement sensor 60 and the displacement speed that has been detected by the displacement speed detection means 12.

Each of the rows in the table that is shown in FIG. 6 corresponds to the positions of the upper cymbal 100, which have been demarcated into five positions, and, in order from the uppermost row, indicate each of the positions of open, half open, slightly open, closed, and tightly closed. Here, "open" means a state in which the upper cymbal 100 and the lower cymbal 200 are opened to the maximum. In addition, when the separation distance between the upper cymbal 100 and the lower cymbal 200 is shortened, the state becomes "half open" and when the separation distance is further shortened, the state becomes "slightly open." In addition, when the separation between the upper cymbal 100 and the lower cymbal 200 is shortened and the separation distance becomes "0," the state becomes "closed" and when the upper cymbal 100 and the lower cymbal 200 are further joined tightly, the state becomes "tightly closed."

On the other hand, each of the columns in the table that is shown in FIG. 6 corresponds to a displacement speed of the upper cymbal 100. The displacement speeds are divided into regions of six steps in unit time from the "V0" of the leftmost column, which indicates that no displacement has taken place, through the "V5" of the rightmost column. With the division into regions of six steps, the more to the right the column is, the faster the displacement speed region becomes.

In the table that is shown in FIG. 6, the value of the field that is the intersection of the position and displacement speed of the upper cymbal 100, which is obtained based on the displacement sensor value that is detected by the displacement sensor 60, is the offset value (SLO) that corresponds to the displacement sensor value that has been detected. For example, in FIG. 6, in the case in which the displacement sensor value that has been detected by the displacement sensor 60 indicates that the position of the upper cymbal 100 is a "slightly open" and, at the same time, the displacement speed of the upper cymbal 100 comes under the "V3" region, "4" is acquired as the offset value (SLO).

Figure 7:
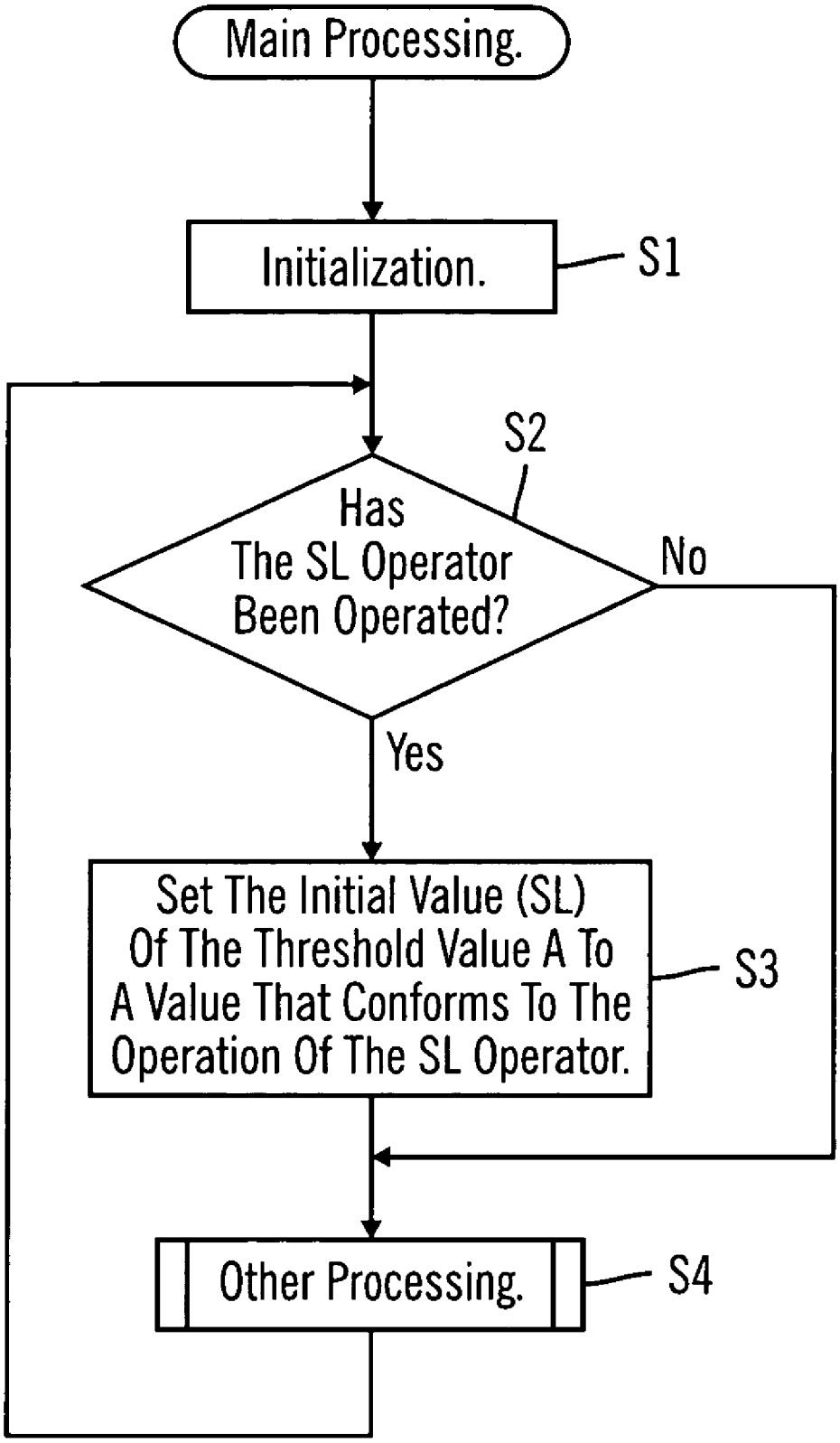
FIG. 7 is a flowchart of main processing that is executed by a CPU of an electronic percussion instrument in accordance with an embodiment of the invention.

An explanation will be given below regarding processes in an electronic percussion instrument 1 that has been configured as described above for the generation of an appropriate musical tone in which the position (in other words, the displacement sensor value) and the displacement speed of the upper cymbal 100 have been taken into account while referring to FIG. 7 through FIG. 9. FIG. 7 is a flowchart of main processing that is executed by the electronic percussion instrument 1. The main processing is repeatedly executed by the CPU 10 during the time that the power is on.

The main processing is launched when the power is turned on; and, first, the displacement sensor value at the time of launching is acquired from the displacement sensor. Various kinds of initialization are carried out such as storing that value in a specified region of the RAM 30 as the displacement sensor value for the time "0" (S1). After the initialization, whether or not the SL operator 50 has been operated is ascertained (S2); and, if the SL operator 50 is being operated (S2: yes), the value that conforms to the operation is set as the initial value (SL) of the threshold value "A" (S3), and the routine shifts to the processing of S4.

On the other hand, if the result that has been ascertained by the processing of S2 is that the SL operator 50 is not being operated (S2: no), since the initial value of the threshold value "A" is the SL value that is currently set, the processing of S3 is skipped and the routine shifts to the processing of S4.

After the execution in the processing of S3 of processing that is based on other operations such as, for example, calibration processing and the like of the displacement sensor value that is detected by the displacement sensor 60, the routine returns to S2 and the main processing is repeated.

Figure 8:
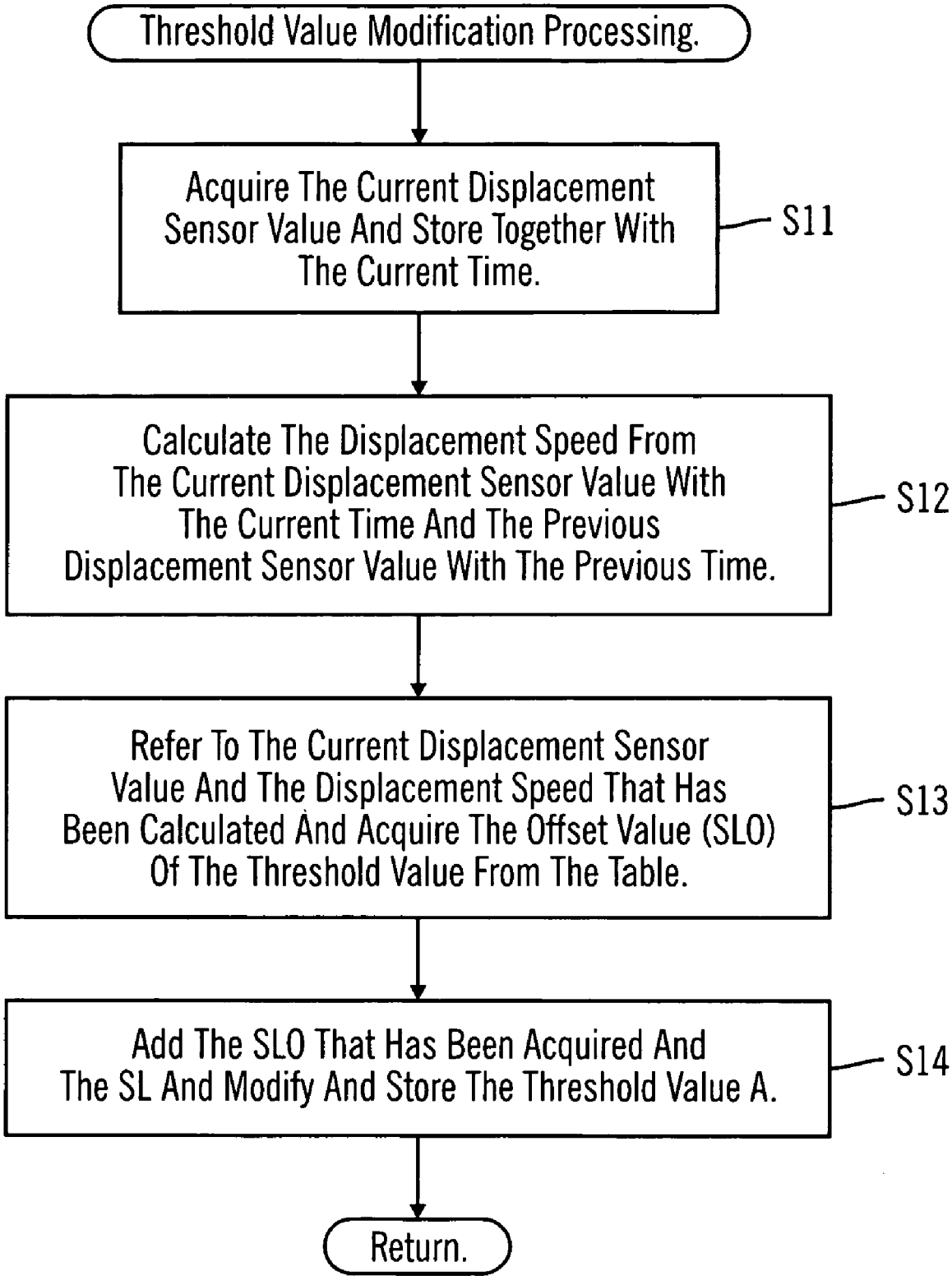
FIG. 8 is a flowchart of threshold modification processing that is executed by a CPU of an electronic percussion instrument in accordance with an embodiment of the invention.

FIG. 8 is a flowchart of threshold modification processing in which the threshold value "A" is modified in conformance with the displacement sensor value that is detected by the displacement sensor 60. The threshold modification processing that is shown in FIG. 8 is a timer interrupt routine that is launched each specified period of time (each several msec). When the threshold modification processing is launched, first, the displacement sensor value of the displacement sensor is acquired and that value is stored in a specified region of the RAM 30 together with the acquisition time (S11).

Next, the displacement speed of the upper cymbal 100 is calculated from the displacement sensor value that has been acquired in the processing of S11 (hereinafter referred to as the "current displacement sensor value") with the acquisition time of this value (hereinafter referred to as the "current time"), and the displacement sensor value that was acquired previously, which is stored in the RAM 30 (hereinafter referred to as the "previous displacement sensor value") with the acquisition time of that value (hereinafter referred to as the "previous time"). The displacement speed is calculated in S12 based on the formula {(current displacement sensor value)−(previous displacement sensor value)}/{(current time)−(previous time)}.

After the processing of S12, the current displacement sensor value and the displacement sensor value that has been calculated by the processing of S12 are referred to, and the offset value (SLO) is acquired from the table that is shown in FIG. 6 (S13). After the processing of S13, the offset value (SLO) that has been acquired and the initial value (SL) of the threshold value "A" that is set by the SL operator 50 are added and the threshold value is modified. The threshold value "A"that has been modified is stored in a specified storage region of the RAM 30 (S14) and the threshold modification processing ends.

Figure 9:
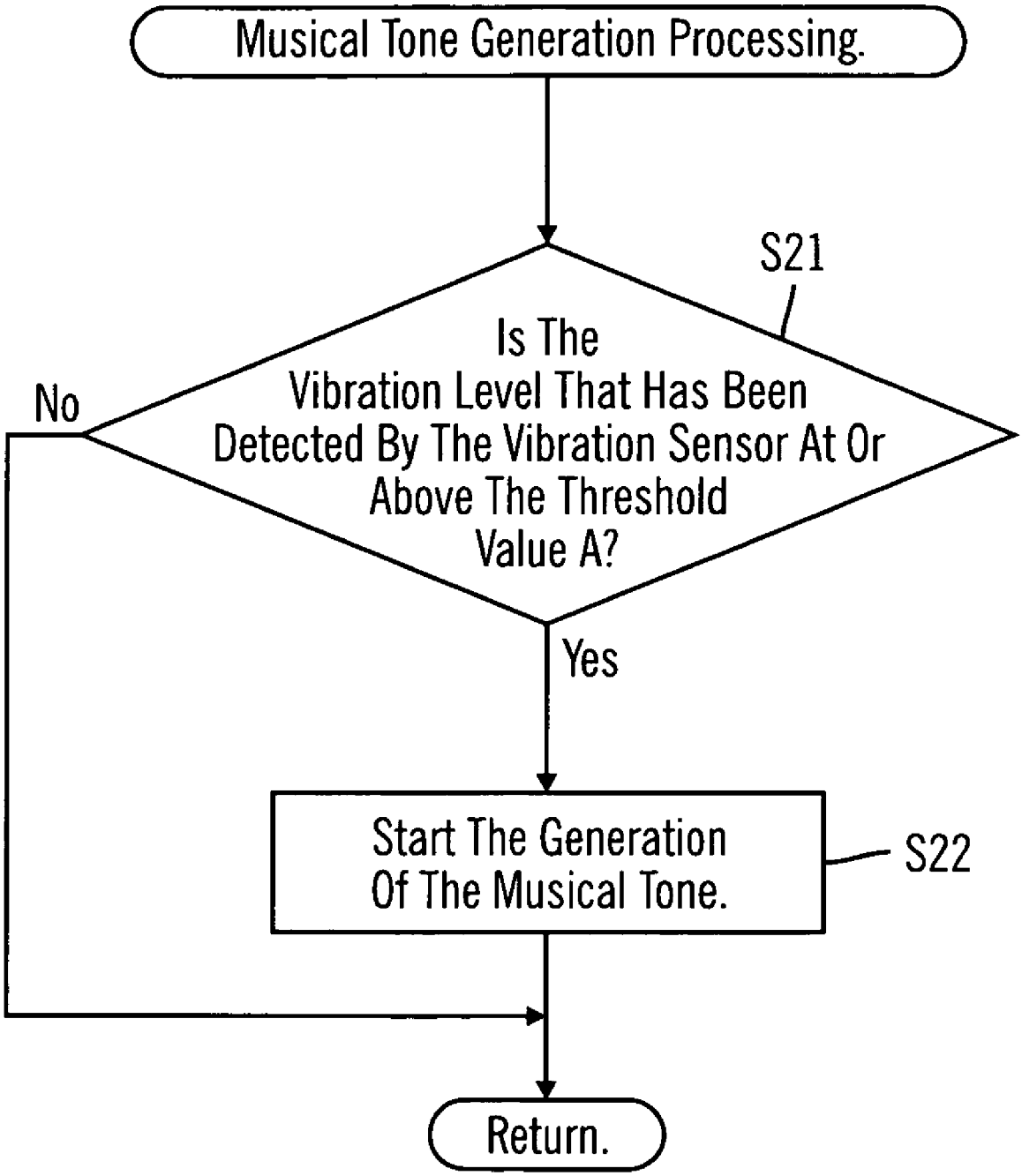
FIG. 9 is a flowchart of musical tone generation processing that is executed by a CPU of an electronic percussion instrument in accordance with an embodiment of the invention.

FIG. 9 is a flowchart of musical tone generation processing in which a musical tone is generated in those cases where a valid vibration due to the striking or contact of the electronic percussion instrument 1 of an embodiment of the present invention has been detected. The musical tone generation processing that is shown in FIG. 9 is a timer interrupt routine that is launched each specified period of time (each several msec). When this musical tone generation processing is launched, first, whether or not the vibration level that has been detected by the vibration sensor 70 is at or above the threshold value "A" that has been stored in the RAM 30 as a result of the processing of S14 is ascertained (S21).

If the result that has been ascertained by the processing of S21 is that the vibration level that has been detected is at or above the threshold value "A" (vibration level≧threshold value "A") that is stored in the RAM 30 (S21: yes), a "note on" is instructed to the sound source 40 and the generation of a musical tone at a timbre that conforms to the current displacement sensor value that has been stored in a specifications storage region of the RAM 30 by the processing of S11 in the threshold modification processing (FIG. 8) is started (S22).

On the other hand, if the result that has been ascertained by the processing of S21 is that the vibration level is less than the threshold value (vibration level<threshold value "A"; S21: no), the processing of S22 is skipped and the musical tone generation processing ends.

As described above, in accordance with the electronic percussion instrument 1 of an embodiment of the invention, the threshold value "A" for the vibration level that is detected by the vibration sensor 70 is modified based on the position and the displacement speed of the upper cymbal 100 that conforms to the displacement sensor value that is detected by the displacement sensor 60. The vibration level that is detected by the vibration sensor 70 is only regarded as a trigger signal in those cases where the vibration level has exceeded the threshold value "A" that has been modified in that manner and, as a result, the generation of a musical tone is started. Therefore, it is always possible to generate an appropriate musical tone without the tone being affected by the position and displacement speed of the upper cymbal 100.

In embodiments described above, the electronic percussion instrument 1 is configured such that the threshold value "A" for the vibration level that is detected by the vibration sensor 70 is based on the position and the displacement speed of the upper cymbal 100 that conforms to the displacement sensor value that is detected by the displacement sensor 60. However, as an illustration of a variation, it may be configured such that the vibration level that is detected by the vibration sensor 70 is compressed based on the position and displacement speed of the upper cymbal 100 that conforms to the displacement sensor value that is detected by the displacement sensor 60, and the musical tone is generated in those cases where the vibration level that has been compressed has exceeded a threshold value that is designated in advance.

In this case, it may be configured such that, in the threshold modification processing of the embodiment described above (FIG. 8), with S15 as a substitute for S12 through S14, the current displacement sensor value and the displacement speed that has been calculated by the processing of S12 are referred to, and the compression ratio for the compression of the vibration level that has been detected by the vibration sensor 70 is acquired from a table (not shown in the drawing). Then, processing may be executed to store the compression ratio in a specified storage region of the RAM 30. On the other hand, it may be configured such that, after launching the musical tone generation processing of the embodiment described above (FIG. 9), prior to the processing of S21, the compression ratio that is stored in the RAM 30 as a result of the processing of S15 described above is applied to the vibration level that has been detected by the vibration sensor 70 as S23. Then, following the execution of the processing to compress the vibration level, the vibration level in S21 and one that has been compressed by the processing of S23 are respectively compared to a threshold value that is designated in advance.

An example of an operation of a musical tone generation means is shown by the threshold modification processing (FIG. 8) and the processing of S21 in the vibration detection processing (FIG. 9). In addition, an example of an operation of a threshold modification means is shown by the processing of S13 through S14 in the threshold modification processing (FIG. 8). In addition, an example of an operation of a displacement speed detection means is shown by the processing of S12 in the threshold modification processing (FIG. 8). In addition, an example of an operation of a vibration level modification means is shown by the processing of S15 cited in the variation illustration described above.

In addition, an example of an operation of a musical tone generation control means is shown by the threshold modification processing (FIG. 8) and the processing of S21 in the vibration modification processing (FIG. 9). In addition, an example of an operation of a threshold modification means is shown by the threshold modification processing (FIG. 8).

An explanation was given above of the present invention based on embodiments. However, the present invention is in no way limited to the preferred embodiments described above and the fact that various modifications and changes are possible that do not deviate from and are within the scope of the essentials of the present invention can be easily surmised.

For example, in the embodiments described above, the configuration is such that the generation of the musical tone is started in those cases where the vibration level (the size) that has been detected by the vibration sensor 70 is at or above the threshold value "A" that has been modified in conformance with the displacement sensor value that is output from the displacement sensor 60. Instead of this, it may also be configured such that the offset value that conforms to the displacement sensor value that is output from the displacement sensor 60 is added to a threshold value "B" for the speed of the rise of the vibration level that is detected by the vibration sensor 70 and the generation of a musical tone is started in those cases where the speed of the rise of the vibration level that has been detected is at or above the threshold value "B" to which the offset value has been added in this manner.

In addition, in the embodiments described above, the configuration is such that the table shown in FIG. 6 is employed and the offset value (SLO) is obtained. However, it may also be configured such that an offset value that is designated in advance in conformance with the position of the upper cymbal 100, which is based on the displacement sensor value, and an offset value that is designated in advance in conformance with the displacement speed of the upper cymbal 100, which is based on the displacement sensor value, are compared and the larger offset value is made the SLO. In this case, the offset value that is designated in advance in conformance with the displacement speed of the upper cymbal 100, which is based on the displacement sensor value, may be made a value in which a specified value (gain) has been applied to the displacement speed that has been detected from the displacement sensor 60.

In addition, in the embodiments described above, the configuration is such that both the position and the displacement speed of the upper cymbal 100 are referred to and the threshold value "A" is modified. However, it may also be configured such that only the position information is referred to or such that only the displacement speed is referred to.

In addition, in the preferred embodiments described above, the configuration is such that the offset value is obtained from the table that is shown in FIG. 6 and the threshold value "A" is modified using that offset value. However, it may also be configured such that the threshold value "A" temporarily follows a specified masking curve in conformance with the position and the displacement speed of the upper cymbal 100.

In addition, in the embodiments described above, the configuration is such that the displacement speed of the upper cymbal 100 is referred to and the threshold value "A" is modified. However, it may also be configured such that the displacement acceleration rate is referred to instead of the displacement speed.

In addition, in the embodiments described above, the configuration is such that both the position and the displacement speed of the upper cymbal 100 are referred to and the threshold value "A" is modified. However, instead of this, it may also be configured such that the modification is done with various parameters such as the sensitivity (the balance between the striking strength and the size of the sound), the dynamics curve (the balance between the striking strength and the volume change), the scan time (the rise time of the striking signal waveform), the retrigger cancellation with which the detection of a single strike as two strikes is prevented, the mask time with which a strike signal that has been generated within a specified set period of time (for example, around 0 to 64 ms) after a single strike is ignored, the cross talk cancellation with which the detection of the vibrations of another cymbal with the vibrations at the time of striking is prevented, and the like. In addition, the threshold value "A" and these parameters may also be combined.

In addition, in the embodiments described above, the configuration is such that the displacement sensor 60 is disposed between the upper cymbal 100 and the lower cymbal 200, but as long as the amount of displacement of the upper cymbal 100 can be detected, that configuration and arrangement location are not a special feature. For example, it may also be configured such that a sensor is disposed that detects the amount that the pedal 440 is stepped on and the amount of the stepping is detected.

In addition, in the embodiments described above, the configuration is such that the vibration sensor 70 is arranged on the upper cymbal 100 via the vibration sensor attachment frame 120, but, for example, it may also be configured such that the sensor is arranged directly on the frame portion of the upper cymbal as is cited in Japanese Laid-Open Patent Application Publication (Kokai) Number 2003-167574.

The embodiments disclosed herein are to be considered in all respects as illustrative, and not restrictive of the invention. The present invention is in no way limited to the embodiments described above. Various modifications and changes may be made to the embodiments without departing from the spirit and scope of the invention. The scope of the invention is indicated by the attached claims, rather than the embodiments. Various modifications and changes that come within the meaning and range of equivalency of the claims are intended to be within the scope of the invention.

What is claimed is:

1. An electronic percussion instrument, comprising:

input means for inputting a vibration level of a vibration of an operator and position information that conforms to a position of the operator;

musical tone generation control means for controlling whether or not a generation of a musical tone is instructed based on the vibration level and the position information in those cases where the vibration level has been input by the input means; and threshold modification means for modifying a threshold value for the vibration level based on the inputted position information.

2. The electronic percussion instrument of claim 1, further comprising:

threshold modification means for modifying a threshold value for the vibration level based on the position information that has been input by the input means;

wherein the musical tone generation control means is one in which the generation of the musical tone is instructed in those cases where the vibration level that has been input by the input means has exceeded the threshold value that has been modified by the threshold modification means.

3. The electronic percussion instrument of claim 1, further comprising:

displacement speed detection means for detecting a displacement speed of the operator based on the position information that has been input in the input means; and threshold modification means for modifying a threshold value for the vibration level in conformance with the displacement speed that has been detected by the displacement speed detection means;

wherein the musical tone generation control means is one in which the generation of the musical tone is instructed in those cases where the vibration level that has been input by the input means has exceeded the threshold value that has been modified by the threshold modification means.

4. The electronic percussion instrument of claim 1, further comprising:

vibration level modification means for modifying the vibration level that has been input by the input means based on the position information that has been input in the input means;

wherein the musical tone generation control means is one in which the generation of the musical tone is instructed in those cases where the vibration level that has been modified by the vibration level modification means has exceeded a specified threshold value.

5. The electronic percussion instrument of claim 1, further comprising:

displacement speed detection means for detecting a displacement speed of the operator based on the position information that has been input in the input means; and vibration level modification means for modifying the vibration level that has been input by the input means in conformance with the displacement speed that has been detected by the displacement speed detection means;

wherein the musical tone generation control means is one in which the generation of the musical tone is instructed in those cases where the vibration level that has been modified by the vibration level modification means has exceeded a specified threshold value.

6. The electronic percussion instrument of claim 1, wherein the operator comprises a unitary, integral body supported both for displacement between plural positions detectable for input by the input means and for vibration detectable for input as vibration levels by the input means.

7. The electronic percussion instrument of claim 6, wherein the input means comprises:

a first sensor for detecting an amount of the displacement of the body; and a second sensor for detecting a level of the vibration of the same body.

8. The electronic percussion instrument of claim 6,, wherein at least one portion of the body is configured for the displacement, and wherein the same at least one portion of the same body is also configured for the vibration.

9. The electronic percussion instrument of claim 8, wherein the at least one portion of the body is configured to be struck to vibrate.

10. The electronic percussion instrument of claim 8, wherein the input means comprises:

a first sensor for detecting an amount of the displacement of the at least one portion of the body; and a second sensor for detecting a level of the vibration of the same at least one portion of the body.

11. The electronic percussion instrument of claim 1, wherein the input means comprises a displacement sensor located at the operator.

12. The electronic percussion instrument of claim 11, wherein the operator comprises a first pad and a second pad, and wherein the displacement sensor is located between the first pad and the second pad.

13. The electronic percussion instrument of claim 11, wherein the displacement sensor comprises a coil spring configured to be compressed by displacement of the first pad relative to the second pad.

14. The electronic percussion instrument of claim 11, wherein the displacement sensor has an opening therethrough, the opening being configured to receive a movable rod adapted to movably support the first pad.

15. An electronic percussion instrument, comprising:

vibration detection means for detecting a vibration level of an operator;

position information acquisition means for acquiring position information that conforms to a position of the operator;

musical tone generation control means for controlling whether or not a generation of a musical tone is instructed based on the vibration level and the position information that has been acquired by the position information acquisition means in those cases where the vibration level has been detected by the vibration detection means; and threshold modification means for modifying a threshold value for the vibration level in conformance with the position information that has been acquired by the position information acquisition means;

wherein the musical tone generation control means is one in which the generation of the musical tone is instructed in those cases where the vibration level that has been detected by the vibration detection means has exceeded the threshold value that has been modified by the threshold modification means.

16. The electronic percussion instrument of claim 15, further comprising:

displacement speed detection means for detecting a displacement speed of the operator based on the position information that has been acquired by the position information detection means; and threshold modification means for modifying a threshold value for the vibration level in conformance with the displacement speed that has been detected by the displacement speed detection means;

wherein the musical tone generation control means is one in which the generation of the musical tone is instructed in those cases where the vibration level that has been detected by the vibration detection means has exceeded the threshold value that has been modified by the threshold modification means.

17. The electronic percussion instrument of claim 15, further comprising:

vibration level modification means for modifying the vibration level that has been detected by the vibration level detection means based on the position information that has been acquired by the position information acquisition means;

wherein the musical tone generation control means is one in which the generation of the musical tone is instructed in those cases where the vibration level that has been modified by the vibration level modification means has exceeded a specified threshold value.

18. The electronic percussion instrument of claim 15, further comprising:

displacement speed detection means for detecting a displacement speed of the operator based on the position information that has been acquired by the position information acquisition means; and vibration level modification means for modifying the vibration level that has been detected by the vibration detection means in conformance with the displacement speed that has been detected by the displacement speed detection means;

wherein the musical tone generation control means is one in which the generation of the musical tone is instructed in those cases where the vibration level that has been modified by the vibration level modification means has exceeded a specified threshold value.

19. An electronic percussion instrument, comprising:

a first pad, the first pad linkable to a rod that can move, the first pad being movable with the rod;

a second pad, the second pad located in a location such that when the rod is moved, the first pad is moved a distance sufficient to contact the second pad;

a vibration sensor for providing a vibration level based on vibrations of the first pad;

a displacement sensor for providing a displacement sensor value based on displacements of the first pad; and circuitry for modifying at least one of a threshold value and the vibration level based on the displacement sensor value, and for comparing, after modification, the vibration level with the threshold value to determine a comparison result;

wherein the comparison result can be used to control whether or not a musical tone is generated by a sound source.

20. The electronic percussion instrument of claim 19, wherein the circuitry modifies the threshold value based on the displacement sensor value to determine a modified threshold value; and wherein the circuitry compares the vibration level with the modified threshold value to determine the comparison result.

21. The electronic percussion instrument of claim 20, wherein the circuitry obtains an offset value from a table based on the displacement sensor value; and wherein the circuitry adds the offset value to the threshold value to determine the modified threshold value.

22. The electronic percussion instrument of claim 20, further comprising:

a storage device;

wherein a first value of the displacement sensor value that is provided by the displacement sensor at a first time is stored in the storage device;

wherein the circuitry receives a second value of the displacement sensor value that is provided by the displacement sensor at a second time, the second time later than the first time;

wherein the circuitry determines a speed of displacement of the first pad based on the first value and the second value and based on a time difference between the second time and the first time; and wherein the circuitry modifies the threshold value based on the speed of displacement of the first pad to determine the modified threshold value.

23. The electronic percussion instrument of claim 22, wherein the circuitry determines a position of the first pad based on the second value; and wherein the circuitry modifies the threshold value based on the speed of displacement of the first pad and based on the position of the first pad to determine the modified threshold value.

24. The electronic percussion instrument of claim 23, wherein the circuitry obtains an offset value from a table based on the speed of displacement of the first pad and the position of the first pad; and wherein the circuitry adds the offset value to the threshold value to determine the modified threshold value.

25. The electronic percussion instrument of claim 20, wherein the circuitry compares the vibration level with the modified threshold value to determine whether or not the vibration level is greater than the modified threshold value; and wherein the sound source is controlled to generate the musical tone when the comparison result reflects that the vibration level is greater than the modified threshold value.

26. The electronic percussion instrument of claim 19, wherein the circuitry modifies the vibration level based on the displacement sensor value to determine a modified vibration level; and wherein the circuitry compares the modified vibration level with the threshold value to determine the comparison result.

27. The electronic percussion instrument of claim 26, wherein the circuitry obtains an offset value from a table based on the displacement sensor value; and wherein the circuitry subtracts the offset value from the vibration level to determine the modified vibration level.

28. The electronic percussion instrument of claim 26, wherein the circuitry determines a speed of displacement of the first pad based on a first value of the displacement sensor value at a first time and a second value of the displacement sensor value at a second time, the second time later than the first time; and wherein the circuitry modifies the vibration level based on the speed of displacement of the first pad to determine the modified vibration level.

29. The electronic percussion instrument of claim 28, wherein the circuitry determines a position of the first pad based on the second value; and wherein the circuitry obtains an offset value from a table based on the speed of displacement of the first pad and based on the position of the first pad;

wherein the circuitry subtracts the offset value from the vibration level to determine the modified vibration level.

30. The electronic percussion instrument of claim 26, wherein the circuitry compares the modified vibration level with the threshold value to determine whether or not the modified vibration level is greater than the threshold value;

wherein the sound source is controlled to generate the musical tone when the comparison result indicates that the modified vibration level is greater than the threshold value.

31. A system for use with an electronic percussion instrument, the electronic percussion instrument having a first pad, a second pad, a vibration sensor for providing a vibration level based on vibrations of the first pad, and a displacement sensor for providing a displacement sensor value based on displacements of the first pad, the system comprising:

circuitry for modifying at least one of a threshold value and the vibration level based on the displacement sensor value, and for comparing, after modification, the vibration level with the threshold value to determine a comparison result;

wherein the comparison result can be used to control whether or not a musical tone is generated by a sound source;

wherein the circuitry determines a position of the first pad based on the displacement sensor value; and wherein the circuitry modifies the threshold value based on the position of the first pad to determine a modified threshold value.

32. The system of claim 31, wherein the circuitry obtains an offset value from a table based on the position of the first pad; and wherein the circuitry adds the offset value to the threshold value to determine the modified threshold value.

33. The system of claim 31, wherein the circuitry determines a speed of displacement of the first pad based on a first value of the displacement sensor value at a first time and a second value of the displacement sensor value at a second time, the second time later than the first time; and wherein the circuitry modifies the threshold value based on the speed of displacement of the first pad to determine a modified threshold value.

34. A system for use with an electronic percussion instrument, the electronic percussion instrument having a first pad, a second pad, a vibration sensor for providing a vibration level based on vibrations of the first pad, and a displacement sensor for providing a displacement sensor value based on displacements of the first pad, the system comprising:

circuitry for modifying at least one of a threshold value and the vibration level based on the displacement sensor value, and for comparing, after modification, the vibration level with the threshold value to determine a comparison result;

wherein the comparison result can be used to control whether or not a musical tone is generated by a sound source;

wherein the circuitry determines a speed of displacement of the first pad based on a first value of the displacement sensor value at a first time and a second value of the displacement sensor value at a second time, the second time later than the first time;

wherein the circuitry modifies the threshold value based on the speed of displacement of the first pad to determine a modified threshold value;

wherein the circuitry determines a position of the first pad based on the second value; and wherein the circuitry modifies the threshold value based on the speed of displacement of the first pad and based on the position of the first pad to determine the modified threshold value.

35. A system for use with an electronic percussion instrument, the electronic percussion instrument having a first pad, a second pad, a vibration sensor for providing a vibration level based on vibrations of the first pad, and a displacement sensor for providing a displacement sensor value based on displacements of the first pad, the system comprising:

circuitry for modifying at least one of a threshold value and the vibration level based on the displacement sensor value, and for comparing, after modification, the vibration level with the threshold value to determine a comparison result;

wherein the comparison result can be used to control whether or not a musical tone is generated by a sound source;

wherein the circuitry modifies the threshold value based on the displacement sensor value to determine a modified threshold value;

wherein the circuitry compares the vibration level with the modified threshold value to determine whether or not the vibration level is greater than the modified threshold value, and determines the comparison result as a result of the comparison; and wherein the sound source is controlled to generate the musical tone when the comparison result indicates that the vibration level is greater than the modified threshold value.

36. A method for determining whether or not to cause a sound source to be controlled to generate a musical tone due to vibrations of a pad of an electronic percussion instrument, the method comprising the steps of:

detecting a vibration level of vibrations of the pad;

detecting a displacement value of displacements of the pad;

modifying at least one of a threshold value and the vibration level based on the displacement value; and comparing, after modification, the vibration level with the threshold value;

wherein the sound source can be controlled based on a result of the comparison.

37. The method of claim 36, wherein the step of detecting a vibration level of vibrations of the pad, comprises the steps of:

providing a vibration sensor on the pad; and determining a vibration level based on an output of the vibration sensor.

38. The method of claim 36, wherein the step of detecting a displacement value of displacements of the pad, comprises the steps of:

providing a displacement sensor;

arranging the displacement sensor between the pad and a second pad; and determining a displacement value based on an output of the displacement sensor.

39. The method of claim 36, wherein the step of modifying at least one of a threshold value and the vibration level based on the displacement value, comprises the step of:

modifying a threshold value based on the displacement value to determine a modified threshold value.

40. The method of claim 39, wherein the step of modifying a threshold value based on the displacement value to determine a modified threshold value, comprises the steps of:

obtaining an offset value from a table based on the displacement value; and modifying a threshold value by adding the offset value to the threshold value to determine a modified threshold value.

41. The method of claim 39, wherein the step of comparing, after modification, the vibration level with the threshold value, comprises the steps of:

comparing the vibration level with the modified threshold value to determine whether or not the vibration level is greater than the modified threshold value.

42. The method of claim 36, wherein the step of modifying at least one of a threshold value and the vibration level based on the displacement value, comprises the step of:

modifying the vibration level based on the displacement value.

43. The method of claim 36, wherein the step of modifying at least one of a threshold value and the vibration level based on the displacement value, comprises the steps of:

determining a position of the pad based on the displacement value; and modifying the threshold value based on the position of the pad to determine a modified threshold value; and wherein the step of comparing, after modification, the vibration level with the threshold value, comprises the step of:

comparing the vibration level with the modified threshold value.

44. The method of claim 36, wherein the step of detecting a displacement value of displacements of the pad, comprises the steps of:

detecting a first value of a displacement value of displacements of the pad at a first time; and detecting a second value of the displacement value of displacements of the pad at a second time;

wherein the step of modifying at least one of a threshold value and the vibration level based on the displacement value, comprises the steps of:

determining a speed of displacement of the pad based on the first value, the second value, the first time, and the second time; and modifying the threshold value based on the speed of displacement of the pad to determine a modified threshold value; and wherein the step of comparing, after modification, the vibration level with the threshold value, comprises the step of:

comparing the vibration level with the modified threshold value.

45. The method of claim 36, wherein the step of detecting a displacement value of displacements of the pad, comprises the steps of:

detecting a first value of a displacement value of displacements of the pad at a first time; and detecting a second value of the displacement value of displacements of the pad at a second time;

wherein the step of modifying at least one of a threshold value and the vibration level based on the displacement value, comprises the steps of:

determining a position of the pad based on the second value;

determining a speed of displacement of the pad based on the first value, the second value, the first time, and the second time; and modifying the threshold value based on the speed of displacement of the pad and based on the position of the pad to determine a modified threshold value; and wherein the step of comparing, after modification, the vibration level with the threshold value, comprises the step of:

comparing the vibration level with the modified threshold value.

46. The method of claim 45, wherein the step of modifying the threshold value based on the speed of displacement of the pad and based on the position of the pad to determine a modified threshold value, comprises the steps of:

obtaining an offset value from a table based on the speed of displacement of the pad and based on the position of the pad; and modifying the threshold value by adding the offset value to the threshold value to determine a modified threshold value.

47. An electronic percussion instrument, comprising:

a first input for receiving a vibration level of a vibration of an operator;

a second input for receiving position information that conforms to a position of the operator;

a controller for controlling whether or not a generation of a musical tone is instructed based on the vibration level and the position information in those cases where the vibration level has been received by the first input; and circuitry for modifying one of the vibration level and a threshold value for the vibration level, based on one of the position information received by the second input and a displacement speed of the operator based on the position information;

wherein the controller is configured to instruct the generation of the musical tone upon determining one of(a) where the circuitry modifies the threshold value, that the vibration level exceeds the threshold value modified by the circuitry, and (b) where the circuitry modifies the vibration level, that the vibration level modified by the circuitry exceeds the threshold value.

48. An electronic percussion instrument, comprising:

a detector for detecting a vibration level of an operator;

an input for receiving position information that conforms to a position of the operator;

a controller for controlling whether or not a generation of a musical tone is instructed based on the vibration level and the position information where the vibration level is detected by the detector; and circuitry for modifying one of the vibration level and a threshold value for the vibration level, based on one of the position information received by the input and a displacement speed of the operator based on the position information;

wherein the controller is configured to instruct the generation of the musical tone upon determining one of (a) where the circuitry modifies the threshold value, that the vibration level exceeds the threshold value modified by the circuitry, and (b) where the circuitry modifies the vibration level, that the vibration level modified by the circuitry exceeds the threshold value.

* * * * *